US012702168B2

(12) United States Patent
Yuan

(10) Patent No.: US 12,702,168 B2
(45) Date of Patent: Aug. 11, 2026

(54) VAPORIZATION CONTROL METHOD AND VAPORIZATION DEVICE

(71) Applicant: SHENZHEN SMOORE TECHNOLOGY LIMITED, Shenzhen (CN)

(72) Inventor: Huakai Yuan, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 345 days.

(21) Appl. No.: 18/349,896

(22) Filed: Jul. 10, 2023

(65) Prior Publication Data

US 2024/0023629 A1 Jan. 25, 2024

(30) Foreign Application Priority Data

Jul. 22, 2022 (CN) ..... 202210866631.6

(51) Int. Cl.

| | |
|---|---|
| ***A24F 47/00*** | (2020.01) |
| ***A24F 40/20*** | (2020.01) |
| ***A24F 40/40*** | (2020.01) |
| ***A24F 40/53*** | (2020.01) |
| ***A24F 40/57*** | (2020.01) |

(52) U.S. Cl.

CPC ..... *A24F 40/53* (2020.01); *A24F 40/20* (2020.01); *A24F 40/40* (2020.01); *A24F 40/57* (2020.01)

(58) Field of Classification Search

CPC ..... A24F 40/20; A24F 40/50; A24F 40/51; A24F 40/53; A24F 40/57

See application file for complete search history.

(56) References Cited

U.S. PATENT DOCUMENTS

| | | | | |
|---|---|---|---|---|
| 10,912,338 | B2 | 2/2021 | Yan et al. | |
| 2018/0049469 | A1 | 2/2018 | Kaufman et al. | |
| 2018/0338537 | A1 | 11/2018 | Yan et al. | |
| 2022/0125110 | A1* | 4/2022 | Frake | A24F 40/20 |
| 2024/0023629 | A1 | 1/2024 | Yuan | |

FOREIGN PATENT DOCUMENTS

| | | | |
|---|---|---|---|
| CN | 107949287 | A | 4/2018 |
| CN | 109691693 | A | 4/2019 |
| CN | 108572202 | B | 10/2020 |
| CN | 215873450 | U | 2/2022 |
| CN | 114259089 | A | 4/2022 |
| CN | 114568763 | A | 6/2022 |

(Continued)

OTHER PUBLICATIONS

European Patent Office, Search Report in European Patent Application No. 23185166.8 (Dec. 12, 2023).

(Continued)

*Primary Examiner* — Eric Yaary

(74) *Attorney, Agent, or Firm* — Sughrue Mion, PLLC

(57) ABSTRACT

A vaporization control method, applicable to a vaporization device that has a vaporization cavity, a first electrical conductor, and a second electrical conductor, includes: acquiring an electrical parameter of the vaporization cavity through the first electrical conductor and the second electrical conductor; and acquiring state information about an aerosol-forming article in the vaporization cavity according to the electrical parameter.

10 Claims, 6 Drawing Sheets

(56) References Cited

FOREIGN PATENT DOCUMENTS

| | | | |
|---|---|---|---|
| CN | 117461900 | A | 1/2024 |
| EP | 4309528 | A1 | 1/2024 |
| WO | 2017045897 | A1 | 3/2017 |

OTHER PUBLICATIONS

Canadian Intellectual Property Office, Office Action in Canadian Patent Application No. 3,206,034 (Nov. 22, 2024).
Communication dated Mar. 6, 2026 issued by the European Patent Office in application No. 23185166.8.
Communication dated Apr. 15, 2026 issued by the Canadian Patent Office in application No. 3206034.
Communication dated Mar. 21, 2026 issued by the State Intellectual Property Office of the P.R.China in application No. 202210866631.6.

* cited by examiner

VAPORIZATION CONTROL METHOD AND VAPORIZATION DEVICE

CROSS-REFERENCE TO PRIOR APPLICATION

Priority is claimed to Chinese Patent Application No. 202210866631.6, filed on Jul. 22, 2022, the entire disclosure of which is hereby incorporated by reference herein.

FIELD

This application relates to the field of vaporization technologies, and in particular, to a vaporization control method and a vaporization device.

BACKGROUND

A vaporization device is configured to heat and vaporize an aerosol-forming article. For example, a solid substrate of plant leaves with a specific aroma is baked in a heat-not-burning manner, so that the solid substrate of leaves is baked into an aerosol. The aerosol-forming article is preferably a solid substrate. The solid substrate includes one or more of powders, particles, fragments, strips, or sheets of one or more of herbal substrates. Alternatively, the solid substrate further includes additional volatile aroma compounds to be released when the substrate is heated.

The existing vaporization device cannot identify whether an effective ingredient of the aerosol-forming article has been completely baked, and the user needs to determine whether to stop baking through the taste. If the aerosol-forming article is overbaked, the burnt smell or smoke is reduced, and insufficient baking may lead to waste and poor user experience.

SUMMARY

In an embodiment, the present invention provides a vaporization control method, applicable to a vaporization device comprising a vaporization cavity, a first electrical conductor, and a second electrical conductor, the vaporization control method comprising: acquiring an electrical parameter of the vaporization cavity through the first electrical conductor and the second electrical conductor; and acquiring state information about an aerosol-forming article in the vaporization cavity according to the electrical parameter.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
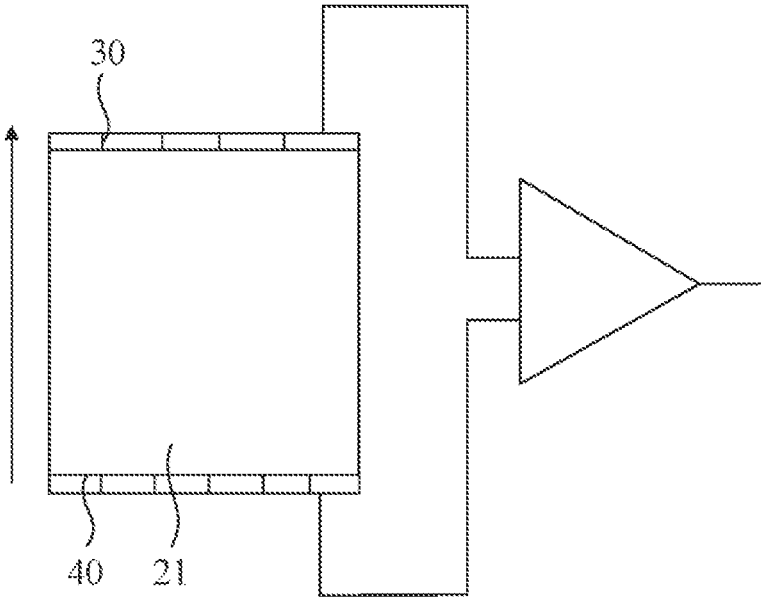
FIG. 1 is a circuit connection diagram of a first electrical conductor and a second electrical conductor in a vaporization device in an embodiment.

In an embodiment, the present invention provides a vaporization control method and a vaporization device to solve the problem that the existing vaporization device cannot identify the baking degree of an aerosol-forming article.

A vaporization control method is applicable to a vaporization device. The vaporization device includes a vaporization cavity, a first electrical conductor, and a second electrical conductor. The vaporization control method includes:

acquiring an electrical parameter of the vaporization cavity through the first electrical conductor and the second electrical conductor; and acquiring state information about an aerosol-forming article in the vaporization cavity according to the electrical parameter.

According to the vaporization control method described above, an electrical parameter of a vaporizer can be acquired through a first electrical conductor and a second electrical conductor to acquire state information about an aerosol-forming article, thereby identifying whether an effective ingredient of the aerosol-forming article is completely consumed, so as to prevent generation of a burnt taste or a significant reduction in smoke resulting from excessive baking, and prevent the waste from being generated due to insufficient baking, which is beneficial to ensure the baking effect and smoking taste of the aerosol-forming article and improve user experience. In an embodiment, the state information about the aerosol-forming article includes an initial state and a vaporization state.

In an embodiment, the acquiring an electrical parameter of the vaporization cavity through the first electrical conductor and the second electrical conductor includes:

acquiring an initial electrical parameter value between the first electrical conductor and the second electrical conductor; and acquiring the initial state of the aerosol-forming article in the vaporization cavity according to the initial electrical parameter value.

In an embodiment, the method further includes after the acquiring the initial state of the aerosol-forming article in the vaporization cavity according to the initial electrical parameter value:

vaporizing the aerosol-forming article in response to the initial electrical parameter value meeting a first preset threshold; and stopping vaporizing or outputting first feedback information in response to the initial electrical parameter value not meeting the first preset threshold. In an embodiment, the method further includes after the acquiring the initial state of the aerosol-forming article in the vaporization cavity according to the initial electrical parameter value:

acquiring a detected electrical parameter value between the first electrical conductor and the second electrical conductor; and acquiring the vaporization state of the aerosol-forming article in the vaporization cavity according to the detected electrical parameter value.

In an embodiment, the method further includes after the acquiring the initial state of the aerosol-forming article in the vaporization cavity according to the initial electrical parameter value:

acquiring a detected electrical parameter value between the first electrical conductor and the second electrical conductor; and acquiring a difference between the detected electrical parameter value and a second preset threshold; and acquiring the vaporization state of the aerosol-forming article in the vaporization cavity according to the difference.

In an embodiment, the method further includes after the acquiring the vaporization state of the aerosol-forming article in the vaporization cavity according to the detected electrical parameter value:

vaporizing the aerosol-forming article in response to the detected electrical parameter value meeting the second preset threshold; and stopping vaporizing or outputting second feedback information in response to the detected electrical parameter value not meeting the second preset threshold.

In an embodiment, the acquiring a detected electrical parameter value between the first electrical conductor and the second electrical conductor includes:

acquiring the detected electrical parameter value between the first electrical conductor and the second electrical conductor once every time interval T.

In an embodiment, the electrical parameter is a capacitance value, a resistance value, or a resistivity.

A vaporization device includes:

a vaporization cavity;

a first electrical conductor and a second electrical conductor, mounted to the vaporization cavity; and a control unit, configured to acquire an electrical parameter between the first electrical conductor and the second electrical conductor and acquire state information about an aerosol-forming article in the vaporization cavity according to the electrical parameter.

According to the vaporization device described above, an electrical parameter of a vaporizer can be acquired through a first electrical conductor and a second electrical conductor to acquire state information about an aerosol-forming article, thereby identifying whether an effective ingredient of the aerosol-forming article is completely consumed, so as to prevent generation of a burnt taste or a significant reduction in smoke resulting from excessive baking, and prevent the waste from being generated due to insufficient baking, which is beneficial to ensure the baking effect and smoking taste of the aerosol-forming article and improve user experience.

REFERENCE NUMERALS

10. Body; 20. Heating component; 21. Vaporization cavity; 30. First electrical conductor; 40. Second electrical conductor; 50. Mouthpiece component; 51. Suction channel; 60. Power supply component.

In order to make the foregoing objectives, features, and advantages of this application more apparent and comprehensible, specific implementations of this application are described in detail below with reference to the accompanying drawings. In the following description, many specific details are described for thorough understanding of this application. However, this application can be implemented in many other manners different from those described herein. A person skilled in the art may make similar improvements without departing from the connotation of this application. Therefore, this application is not limited to the specific embodiments disclosed below.

In the description of this application, it should be understood that orientation or position relationships indicated by the terms such as "center", "longitudinal", "transverse", "length", "width", "thickness", "on", "below", "front", "back", "left", "right", "vertical", "horizontal", "top", "bottom", "inside", "outside", "clockwise", "anticlockwise", "axial direction", "radial direction", and "circumferential direction" are based on orientation or position relationships shown in the accompanying drawings, and are used only for ease and brevity of description of this application, rather than indicating or implying that the mentioned apparatus or element needs to have a particular orientation or be constructed and operated in a particular orientation. Therefore, such terms should not be construed as a limitation on this application.

In addition, terms "first" and "second" are merely for the purpose of description, and cannot be construed as indicating or implying relative importance or implicitly specifying the number of technical features indicated. Therefore, a feature restricted by "first" or "second" may explicitly indicate or implicitly include at least one of the features. In description of this application, "multiple" means at least two, such as two and three unless otherwise explicitly and specifically defined.

In this application, unless otherwise explicitly specified and defined, terms such as "initial", "connected", "connection", and "fixed" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two elements, or interaction between two elements, unless otherwise explicitly defined. A person of ordinary skill in the art may understand the specific meanings of the foregoing terms in this application according to specific situations.

In this application, unless otherwise explicitly specified or defined, the first feature being located "on" or "below" the second feature may be the first feature directly contacting the second feature, or the first feature indirectly contacting the second feature through an intermediary. In addition, the first feature being "above", "over", or "on" the second feature may indicate that the first feature is directly above or obliquely above the second feature, or may merely indicate that the first feature is at a higher horizontal position than the second feature. The first feature being "below", "under", and "beneath" the second feature may be that the first feature is directly below or obliquely below the second feature, or merely indicates that the first feature is at a lower horizontal position than the second feature.

It should be noted that, when an element is referred to as "being fixed to" or "being arranged on" the other element, the element may be directly on the other element, or an intermediate element may exist. When an element is considered to be "connected" to the other element, the element may be directly connected to the other element or an intermediate element may exist. The terms "vertical", "horizontal", "upper", "lower", "left", "right", and similar expressions used in this specification are only for purposes of illustration but are not intended to indicate a unique implementation.

Figure 2:
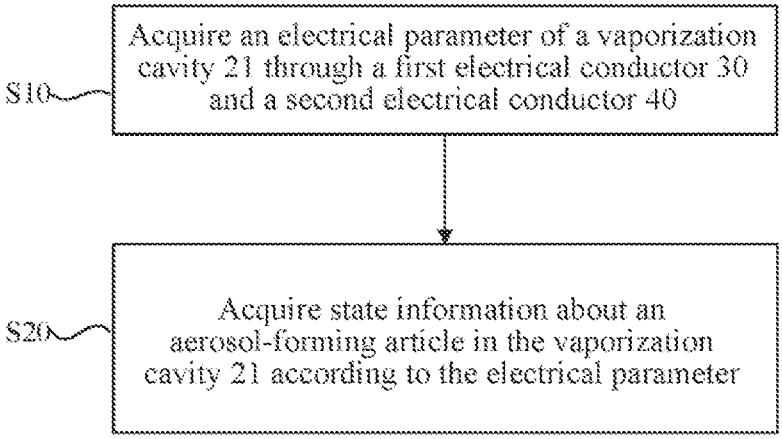
FIG. 2 is a schematic diagram of a vaporization control method in an embodiment.
Figure 3:
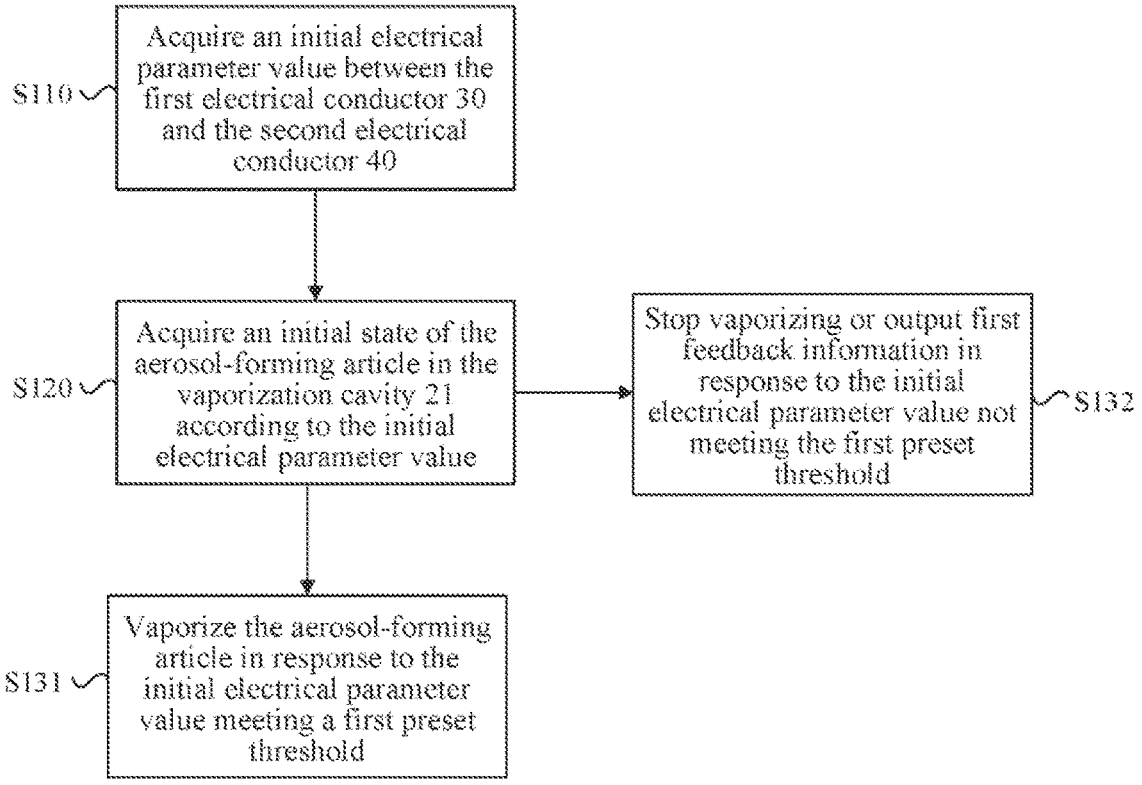
FIG. 3 is a schematic diagram of step S210 in the vaporization control method shown in FIG. 2.
Figure 4:
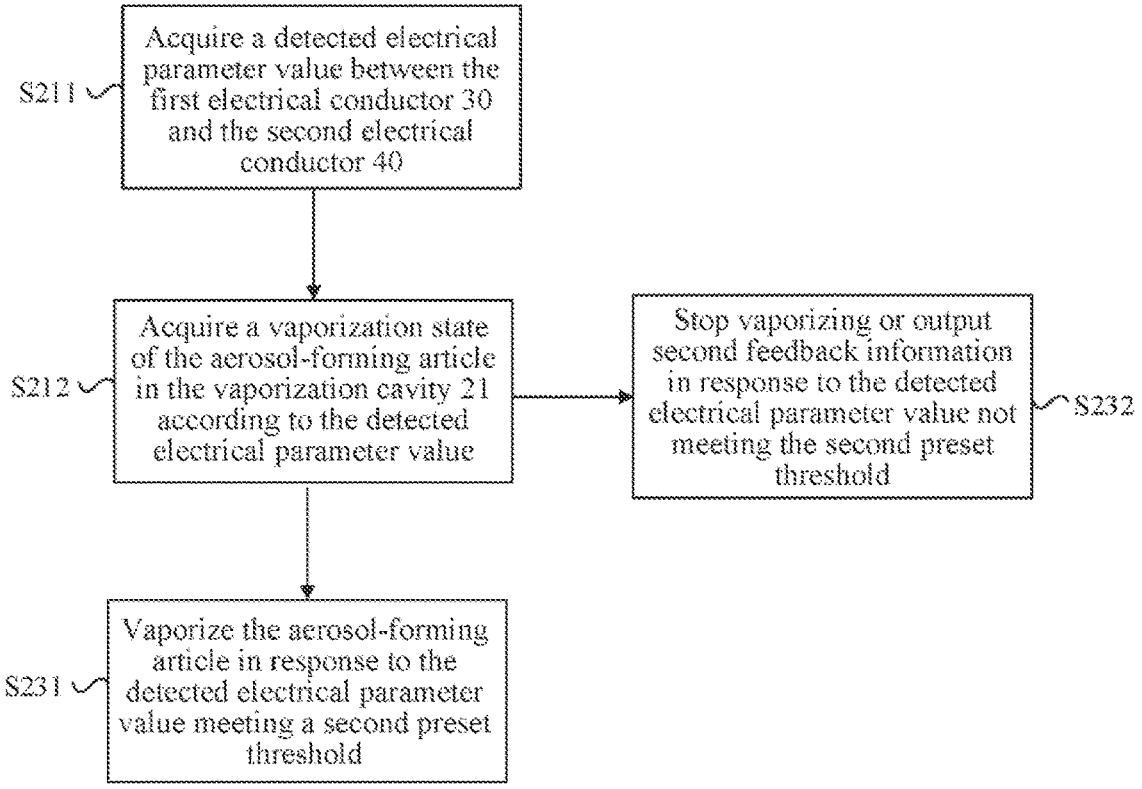
FIG. 4 is a schematic diagram of step S220 in the vaporization control method shown in FIG. 2.
Figure 5:
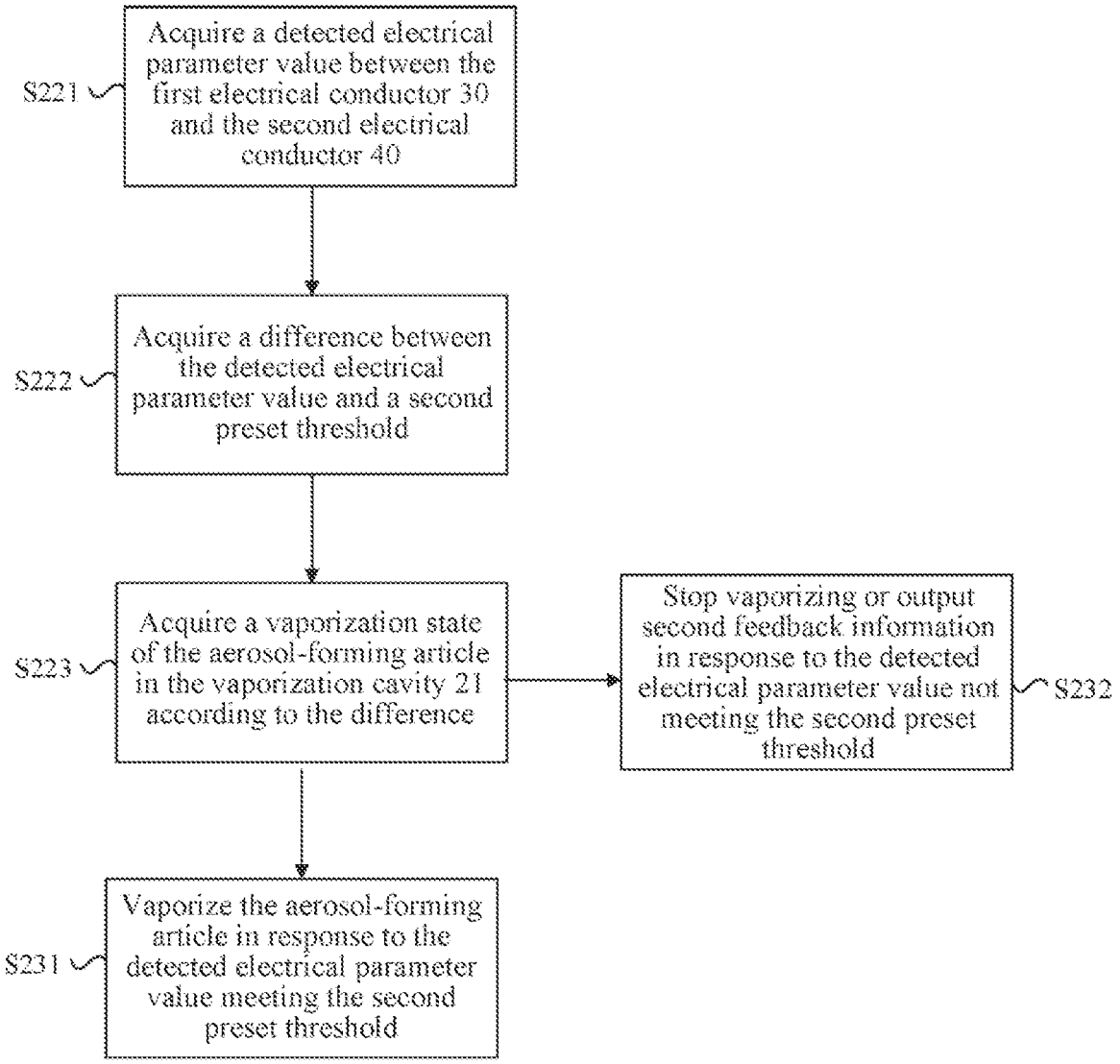
FIG. 5 is a schematic diagram of step S230 in the vaporization control method shown in FIG. 2.
Figure 6:
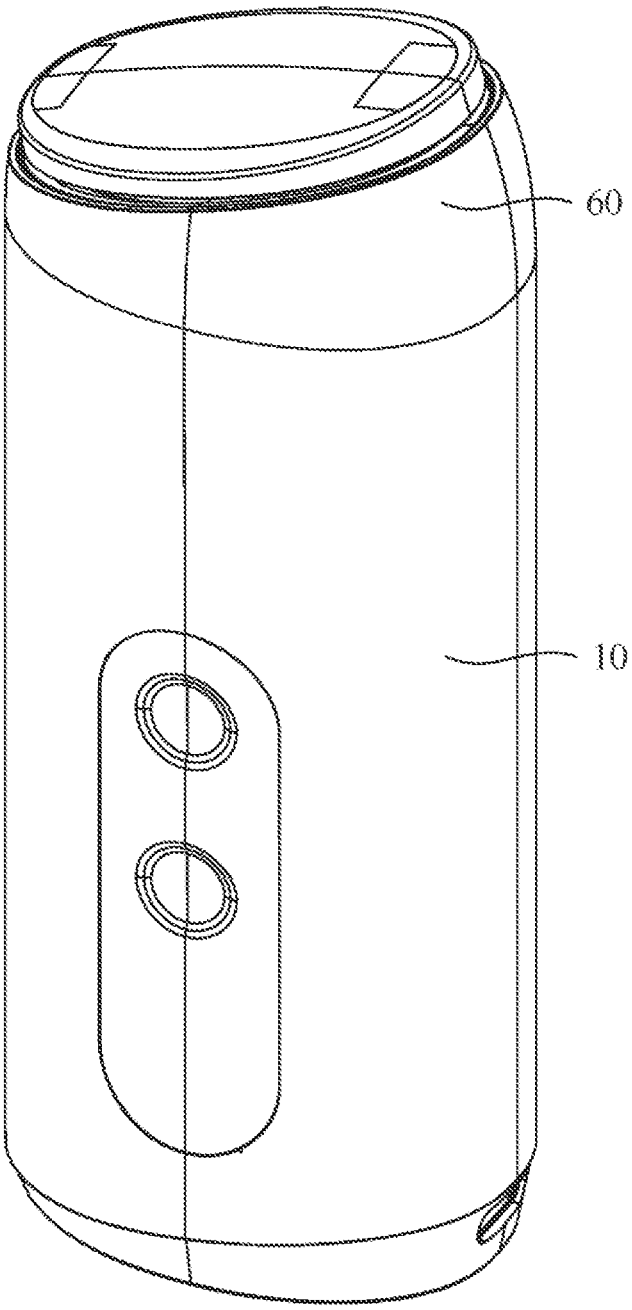
FIG. 6 is a schematic diagram of a vaporization device in an embodiment.
Figure 7:
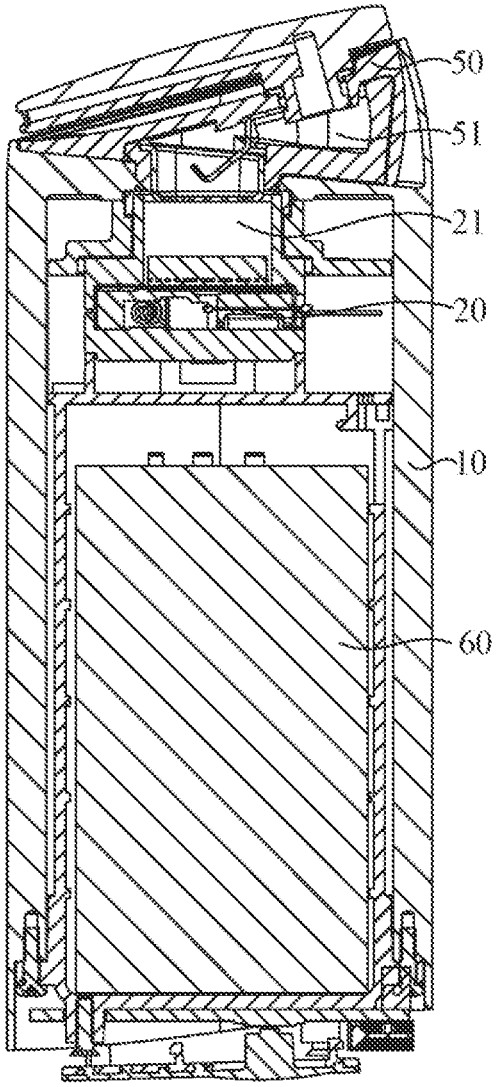
FIG. 7 is a cross-sectional view of the vaporization device shown in FIG. 6.

FIG. 1 is a circuit connection diagram of a first electrical conductor 30 and a second electrical conductor 40 in a vaporization device in an embodiment. FIG. 2 is a schematic diagram of a vaporization control method in an embodiment. FIG. 3 is a schematic diagram of step S210 in the vaporization control method shown in FIG. 2. FIG. 4 is a schematic diagram of step S220 in the vaporization control method shown in FIG. 2. FIG. 5 is a schematic diagram of step S230 in the vaporization control method shown in FIG. 2. FIG. 6 is a schematic diagram of a vaporization device in an embodiment. FIG. 7 is a cross-sectional view of the vaporization device shown in FIG. 6. For ease of description, the accompanying drawings only show the structures related to the present invention.

Referring to FIG. 1, the vaporization device is configured to heat and vaporize an aerosol-forming article. For example, a solid substrate of plant leaves with a specific aroma is baked in a heat-not-burning manner, so that the solid substrate of leaves is baked into an aerosol. The aerosol-forming article is preferably a solid substrate. The solid substrate includes one or more of powders, particles, fragments, strips, or sheets of one or more of herbal substrates. Alternatively, the solid substrate further includes additional volatile aroma compounds to be released when the substrate is heated.

Referring to FIG. 1 and FIG. 2, the vaporization control method in an embodiment is applicable to a vaporization device. The vaporization device includes a vaporization cavity 21, a first electrical conductor 30, and a second electrical conductor 40. The vaporization control method includes the following steps.

S10. Acquire an electrical parameter of a vaporization cavity 21 through a first electrical conductor 30 and a second electrical conductor 40.

S20. Acquire state information about an aerosol-forming article in the vaporization cavity 21 according to the electrical parameter.

According to the vaporization control method described above, an electrical parameter of a vaporizer can be acquired through a first electrical conductor 30 and a second electrical conductor 40 to acquire state information about an aerosol-forming article, thereby identifying whether an effective ingredient of the aerosol-forming article is completely consumed, so as to prevent generation of a burnt taste or a significant reduction in smoke resulting from excessive baking, and prevent the waste from being generated due to insufficient baking, which is beneficial to ensure the baking effect and smoking taste of the aerosol-forming article and improve user experience.

It should be noted that the first electrical conductor 30 and the second electrical conductor 40 have electrical conductivity. When the first electrical conductor 30 and the second electrical conductor 40 are electrically turned on, an electrical signal circuit is formed between the control unit and the first electrical conductor 30 and the second electrical conductor 40, the electrical parameter between the first electrical conductor 30 and the second electrical conductor 40 is acquired through the control unit, and the state information about the aerosol-forming article in the vaporization cavity 21 is acquired according to the electrical parameter. According to some embodiments of this application, the state information about the aerosol-forming article includes a presence/absence state, an initial state, and a vaporization state.

Specifically, the initial state includes the presence/absence, a packing density, or a water content of the aerosol-forming article. The vaporization state includes a vaporization amount of the aerosol-forming article.

For example, when the packing density or water content of the aerosol-forming article is excessively large or excessively small, the baking effect and the baking time of the aerosol-forming article may be affected, the baking taste of the aerosol-forming article cannot be effectively ensured. By acquiring the initial state, it can be identified in time whether the initial state of the aerosol-forming article meets the use requirement.

According to some embodiments of this application, referring to FIG. 1 and FIG. 3, the acquiring an electrical parameter of the vaporization cavity 21 through the first electrical conductor 30 and the second electrical conductor 40 includes the following steps.

S110. Acquire an initial electrical parameter value between the first electrical conductor 30 and the second electrical conductor 40.

S120. Acquire an initial state of the aerosol-forming article in the vaporization cavity 21 according to the initial electrical parameter value.

Specifically, the initial electrical parameter value is the initial electrical parameter value obtained when the first electrical conductor 30 and the second electrical conductor 40 are electrically turned on.

According to some embodiments of this application, referring to FIG. 1 and FIG. 3, after the acquiring the initial state of the aerosol-forming article in the vaporization cavity 21 according to the initial electrical parameter value, the method further includes the following steps.

S131. Vaporize the aerosol-forming article in response to the initial electrical parameter value meeting a first preset threshold.

S132. Stop vaporizing or output first feedback information in response to the initial electrical parameter value not meeting the first preset threshold.

Through the above arrangement, it is determined according to the initial electrical parameter value whether the initial state of the aerosol-forming article meets the use requirement, and the user is reminded to adjust the initial state of the aerosol-forming article in time, which is beneficial to ensure the subsequent baking effect of the aerosol-forming article.

Specifically, referring to FIG. 7, when the initial electrical parameter value is equal to the first preset threshold, the control unit drives the heating component 2020 in the vaporization device to operate to heat the aerosol-forming article, thereby vaporizing the aerosol-forming article.

Specifically, the first feedback information is an acousto-optic prompt or a vibration prompt. In this way, the user can be reminded in time to adjust the state of the aerosol-forming article in the vaporization cavity 21, so that the baking action can be performed after the initial electrical parameter value meets preset requirements. For example, when the initial electrical parameter value is less than the first preset threshold, a yellow indication light may be emitted to alert the user. When the initial electrical parameter value is greater than the first preset threshold, a red indicator light may be on to remind the user.

According to an embodiment of this application, referring to FIG. 1 and FIG. 4, after the acquiring the initial state of the aerosol-forming article in the vaporization cavity 21 according to the initial electrical parameter value, the method further includes the following steps.

S211. Acquire a detected electrical parameter value between the first electrical conductor 30 and the second electrical conductor 40.

S212. Acquire a vaporization state of the aerosol-forming article in the vaporization cavity 21 according to the detected electrical parameter value.

According to another embodiment of this application, referring to FIG. 1 and FIG. 5, after the acquiring the initial state of the aerosol-forming article in the vaporization cavity 21 according to the initial electrical parameter value, the method further includes the following steps.

S221. Acquire a detected electrical parameter value between the first electrical conductor 30 and the second electrical conductor 40.

S222. Acquire a difference between the detected electrical parameter value and a second preset threshold.

S223. Acquire a vaporization state of the aerosol-forming article in the vaporization cavity 21 according to the difference.

Specifically, the vaporization state of the aerosol-forming article in the vaporization cavity 21 can be obtained through table lookup or calculation according to the detected electrical parameter value or the difference. In this way, the vaporization state of the aerosol-forming article can be quickly obtained.

According to some embodiments of this application, referring to FIG. 1, FIG. 4, and FIG. 5, after the acquiring the vaporization state of the aerosol-forming article in the vaporization cavity 21 according to the detected electrical parameter value, the method further includes the following steps.

S231. Vaporize the aerosol-forming article in response to the detected electrical parameter value meeting a second preset threshold.

S232. Stop vaporizing or output second feedback information in response to the detected electrical parameter value not meeting the second preset threshold.

Specifically, when the detected electrical parameter value is less than the second preset threshold, the control unit drives the heating component 20 in the vaporization device to operate to heat the aerosol-forming article, thereby performing the baking action.

Specifically, the second feedback information is an acousto-optic prompt or a vibration prompt. In this way, the user can be reminded to stop the baking action in time. For example, when the detected electrical parameter value is equal to the second preset threshold, a green indicator light is on to remind the user. When the detected electrical parameter value is greater than the second preset threshold, a red indicator light is on to remind the user.

It may be understood that during the baking of the aerosol-forming article, the detected electrical parameter value continues to increase. When the detected electrical parameter value is less than the second preset threshold, it indicates that the aerosol-forming article has not been completely baked and needs to be baked continuously. When the detected electrical parameter value is equal to or greater than the second preset threshold, a scorched flavor or a burnt smell may be generated during smoking if the baking is continued, which affects the smoking taste of the user. Through the above steps, the aerosol-forming article is in the optimal baking range, which is beneficial to ensure the baking effect and smoking taste of the aerosol-forming article.

According to some embodiments of this application, the acquiring a detected electrical parameter value between the first electrical conductor 30 and the second electrical conductor 40 includes:

acquiring the detected electrical parameter value between the first electrical conductor 30 and the second electrical conductor 40 once every time interval T.

Herein, the time T may be several minutes or several hours, which is set according to actual needs. Each detected electrical parameter value may be directly compared with the second preset threshold, or a plurality of detected electrical parameter values may be averaged and compared with the second preset threshold. Through the above steps, the baking degree of the aerosol-forming article can be determined more accurately.

According to some embodiments of this application, the electrical parameter is a capacitance value, a resistance value, or a resistivity.

For example, when the electrical parameter is the resistance value, the second preset threshold is in a range of 16 MΩ to 20 MΩ.

When the detected electrical parameter value is less than the second preset threshold, the baking action is performed. When the detected electrical parameter value is equal to or greater than the second preset threshold, the baking action is stopped or the second feedback information is outputted.

Referring to FIG. 1, FIG. 6, and FIG. 7, the vaporization device in an embodiment includes the vaporization cavity 21, the first electrical conductor 30, the second electrical conductor 40, and the control unit. The first electrical conductor 30 and the second electrical conductor 40 are mounted to the vaporization cavity 21. The control unit is configured to acquire the electrical parameter between the first electrical conductor 30 and the second electrical conductor 40, and acquire the state information about the aerosol-forming article in the vaporization cavity 21 according to the electrical parameter.

According to the vaporization device described above, an electrical parameter of a vaporizer can be acquired through a first electrical conductor 30 and a second electrical conductor 40 to acquire state information about an aerosol-forming article, thereby identifying whether an effective ingredient of the aerosol-forming article is completely consumed, so as to prevent generation of a burnt taste or a significant reduction in smoke resulting from excessive baking, and prevent the waste from being generated due to insufficient baking, which is beneficial to ensure the baking effect and smoking taste of the aerosol-forming article and improve user experience.

Herein, the first electrical conductor 30 and the second electrical conductor 40 may be arranged in the vaporization cavity 21 or outside the vaporization cavity 21. The first electrical conductor 30 and the second electrical conductor 40 have electrical conductivity, and when the first electrical conductor 30 and the second electrical conductor 40 are electrically turned on, an electrical signal circuit is formed between the control unit and the first electrical conductor 30 and the second electrical conductor 40.

Specifically, the vaporization device is a conductive heating-type vaporization pot. Referring to FIG. 6 and FIG. 7, the vaporization device further includes a body 10, a heating component 20, and a mouthpiece component 50. The control unit and the heating component 20 are arranged in the body 10, and the mouthpiece component 50 is fitted to an end of the body 10. The heating component 20 has the vaporization cavity 21 for baking the aerosol-forming article, and the mouthpiece component 50 has a suction channel 51 in communication with the vaporization cavity 21.

With reference to FIG. 1, the first electrical conductor 30 and the second electrical conductor 40 are arranged at opposite sides of the vaporization cavity 21, and the first electrical conductor 30 and the second electrical conductor 40 both have a mesh structure.

In this embodiment, the first electrical conductor 30 is arranged on a top side of the vaporization cavity 21, and the second electrical conductor 40 is arranged on a bottom side of the vaporization cavity 21. When the user inhales, airflow flows in the arrow direction shown in FIG. 3. The first electrical conductor 30 and the second electrical conductor 40 are both provided with several grids to cause the airflow in the vaporization cavity 21 to circulate. The grids may be circular, rectangular, polygonal, or in other shapes, and the specific shapes of the grids are not limited herein.

In other embodiments, the first electrical conductor 30 may be arranged in the suction channel 51, and the second electrical conductor 40 may be arranged on a circumferential side wall of the vaporization cavity 21. Alternatively, the first electrical conductor 30 and the second electrical conductor 40 are arranged on the same side of the vaporization cavity 21.

More specifically, referring to FIG. 7, the vaporization device further includes a power supply component 60 and a circuit board that are electrically connected. The power supply component 60 is electrically connected to the heating component 20 and configured to supply power to the heating component 20.

It should be noted that the aerosol-forming article is removably arranged in the vaporization cavity 21. When the aerosol-forming article is in the vaporization cavity 21, the heating component 20 heats the aerosol-forming article, so that the aerosol-forming article releases a plurality of volatile compounds. The power supply component 60 is configured to supply power, and the circuit board is configured to guide a current between the power supply component 60 and the heating component 20. The heating component 20 heats and vaporizes the aerosol-forming article by using the electric energy provided by the power supply component 60, and generates aerosol for the user to suck.

The technical features in the foregoing embodiments may be randomly combined. For concise description, not all possible combinations of the technical features in the embodiments are described. However, provided that combinations of the technical features do not conflict with each other, the combinations of the technical features are considered to fall within the scope described in this specification.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporization control method, applicable to a vaporization device comprising a vaporization cavity, a first electrical conductor, and a second electrical conductor, the vaporization control method comprising:

acquiring an initial electrical parameter of the vaporization cavity through the first electrical conductor and the second electrical conductor;

acquiring an initial state of an aerosol-forming article in the vaporization cavity according to the initial electrical parameter;

after the acquiring the initial state of the aerosol-forming article in the vaporization cavity according to the initial electrical parameter value:

acquiring a detected electrical parameter value between the first electrical conductor and the second electrical conductor;

acquiring a difference between the detected electrical parameter value and a first preset threshold; and acquiring a vaporization state of the aerosol-forming article in the vaporization cavity according to the difference.

2. The vaporization control method of claim 1, further comprising:

after acquiring the initial state of the aerosol-forming article in the vaporization cavity according to the initial electrical parameter value:

vaporizing the aerosol-forming article in response to the initial electrical parameter value meeting the first preset threshold; and stopping vaporizing or outputting a first feedback information in response to the initial electrical parameter value not meeting the first preset threshold.

3. The vaporization control method of claim 1, further comprising:

after the acquiring the vaporization state of the aerosol-forming article in the vaporization cavity according to the detected electrical parameter value:

vaporizing the aerosol-forming article in response to the detected electrical parameter value meeting a second preset threshold; and stopping vaporizing or outputting a second feedback information in response to the detected electrical parameter value not meeting the second preset threshold.

4. The vaporization control method of claim 1, further comprising:

acquiring the detected electrical parameter value between the first electrical conductor and the second electrical conductor once every time interval.

5. The vaporization control method of claim 1, wherein the electrical parameter comprises a capacitance value, a resistance value, or a resistivity.

6. A vaporization device, comprising:

a vaporization cavity;

a first electrical conductor and a second electrical conductor, mounted to the vaporization cavity; and a control unit configured to acquire an initial electrical parameter between the first electrical conductor and the second electrical conductor, acquire an initial state of an aerosol-forming article in the vaporization cavity according to the initial electrical parameter, after acquire the initial state of the aerosol-forming article in the vaporization cavity according to the initial electrical parameter value:

acquire a detected electrical parameter value between the first electrical conductor and the second electrical conductor, acquire a difference between the detected electrical parameter value and a first preset threshold, and acquire a vaporization state of the aerosol-forming article in the vaporization cavity according to the difference.

7. The vaporization device of claim 6, further comprising:

after acquire the initial state of the aerosol-forming article in the vaporization cavity according to the initial electrical parameter value:

vaporize the aerosol-forming article in response to the initial electrical parameter value meeting the first preset threshold; and stop vaporize or output a first feedback information in response to the initial electrical parameter value not meeting the first preset threshold.

8. The vaporization device of claim 6, further comprising:

after the acquire the vaporization state of the aerosol-forming article in the vaporization cavity according to the detected electrical parameter value:

vaporize the aerosol-forming article in response to the detected electrical parameter value meeting a second preset threshold; and stop vaporize or output a second feedback information in response to the detected electrical parameter value not meeting the second preset threshold.

9. The vaporization device of claim 6, further comprising:

acquire the detected electrical parameter value between the first electrical conductor and the second electrical conductor once every time interval.

10. The vaporization device of claim 6, wherein the electrical parameter comprises a capacitance value, a resistance value, or a resistivity.

* * * * *